US007306469B1

(12) United States Patent
Slautterback

(10) Patent No.: US 7,306,469 B1
(45) Date of Patent: Dec. 11, 2007

(54) SELF-LATCHING QUICK DISCONNECT CONNECTOR

(76) Inventor: Frederick A. Slautterback, 652 Redwood Ave., Sand City, CA (US) 93955

( * ) Notice: Subject to any disclaimer, the term of this patent is extended or adjusted under 35 U.S.C. 154(b) by 0 days.

(21) Appl. No.: 11/695,184

(22) Filed: Apr. 2, 2007

(51) Int. Cl.
*H01R 4/58* (2006.01)

(52) U.S. Cl. ..... 439/86; 439/89; 439/848; 439/593

(58) Field of Classification Search ..... 439/86, 439/89, 848, 593
See application file for complete search history.

(56) References Cited

U.S. PATENT DOCUMENTS 2,567,727 A * 9/1951 Quackenbush ..... 439/837
3,243,756 A * 3/1966 Ruete et al. ..... 439/89
3,344,391 A * 9/1967 Ruete ..... 439/89
4,426,127 A 1/1984 Kubota
4,934,367 A * 6/1990 Daglow et al. ..... 439/527
5,041,027 A * 8/1991 Lien ..... 439/796
5,112,236 A * 5/1992 Martin et al. ..... 439/86
5,591,039 A * 1/1997 Matthews ..... 439/181
5,735,716 A * 4/1998 Bilezikjian ..... 439/843
5,795,165 A * 8/1998 Jarl ..... 439/86
6,238,230 B1 5/2001 Sadler et al.

* cited by examiner

*Primary Examiner*—Tho D. Ta
(74) *Attorney, Agent, or Firm*—Schneck & Schneck; Thomas Schneck

(57) ABSTRACT

A quick disconnect fastener is disclosed. The quick disconnect fastener includes a male member for joining to a first end of a first loop structure including a male body section, a probe section coupled to the body section, the probe section further including a probe head support structure coupled to a forward head section. The quick disconnect fastener also includes a cavity defined rearwardly in the male body section for receiving the first end of the loop structure. The quick disconnect fastener further includes a female member for joining to a second end of a second loop structure including, a female body section having an opening including, a flexible material in the opening configured to compressibly form around the probe section when the male member is coupled to the female member. The quick disconnect fastener also includes a cavity section defined rearwardly in the female body section for joining to the second end of the second loop structure.

20 Claims, 5 Drawing Sheets

SELF-LATCHING QUICK DISCONNECT CONNECTOR

TECHNICAL FIELD

The present invention generally relates to quick-disconnect connectors, mainly electrical lines, but also for optical lines, and fluid conduits.

BACKGROUND OF THE INVENTION

Electrical lines are commonly joined to electrical circuits by connectors. Electric circuits and networks are generally connected to the outside world by conductive lines or wires having connectors. Many of these connectors need to be quick disconnect connectors.

Optical connectors are commonly used in joining optical transmission lines. Fluid couplers are commonly used to provide easy connection and disconnection of fluid lines such as water, oil, gas, and air lines.

Consequently, for electrical, optical, and fluid applications, there is generally a need for quick disconnect connectors in order to simplify assembly, minimize downtime, and increase safety.

For example, field replaceable electrical components, such as used in telecommunications, are often installed in housings, and then hardwired with insulated wires to terminal blocks (also called terminal boards or strips). However, installing cables may be difficult, since the wires must often be screwed down. Furthermore, the terminals are generally exposed, and thus susceptible to electrical shorting as well as human injury.

Likewise, optical connectors tend to be unwieldy and difficult to use. For example, unless the fiber is properly aligned between the male and female sections of the connector, the optical signal cannot be transmitted through the connector. Furthermore, when attaching the connectors, incorrect cleaving of the fiber optic line may result in lips and hackles further degrading the optical signal. In addition, unprotected connector ends can experience damage by impact, airborne dust particles, or excess humidity or moisture.

In addition, for electrical, optical, and fluid configurations, applications in which components are movable also tend to create safety and physical damage issues. For example, in a hospital, a patient may be connected to medical monitoring or drug delivery equipment. However, if the patient rapidly separates from the equipment, for example by getting out of bed, the patient may become injured and/or the equipment may become damaged, as connecting cables or tubes stretch taut and then snap.

Consequently, what is needed for electrical, optical, and fluid applications, is a quick disconnect connector in order to simplify assembly, minimize downtime, minimize damage, and increase safety.

SUMMARY OF THE INVENTION

In accordance with the present invention, a miniature, self-seating, quick disconnect connector is advantageously employed in order to facilitate the mechanical joining of electrical, optical, or fluid lines.

The connector of the present invention is configured to be substantially secure when mated, yet allowing a user to easily insert and/or remove the male (pin) member from the socket (female) member with minimal force because it is self-seating. Briefly, the self-seating feature of the connector of this invention employs an axial flexible or elastomeric material in an opening of a female connector member to compressibly form around and frictionally secure a co-axial probe of a male connector member.

The connector of the present invention has axial symmetry such that the male and female connector members are self-aligned with a uniform outer profile and may be fully rotated about the longitudinal axis of when inserted into female connector member, reducing any potential physical stress caused by tension or stress on the terminating lines, as well as simplifying the insertion of male connector member with female connector member. The outer profile of the connector is not much greater than the lines that are being joined.

BEST MODE FOR CARRYING OUT THE INVENTION

Figure 1:
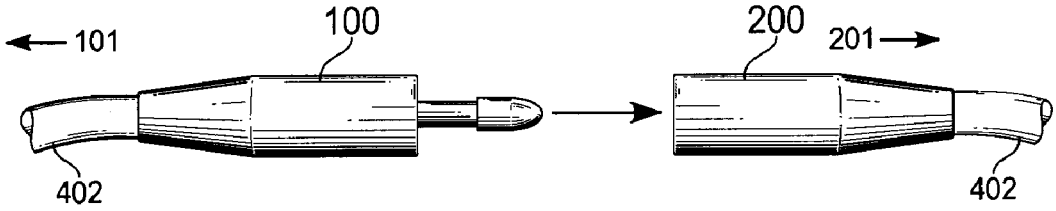
FIG. 1 is a plan side view of a male connector member coupled to a female connector member for joining electrical, optical, or fluid lines in accordance with the present invention.

Referring to FIG. 1, a male connector member 100, terminating line 402, is coupled to a female connector member 200, terminating line 404, in order to facilitate the temporarily mechanical joining of a first electrical, optical, or fluid line 101, to a second electrical, optical, or fluid line 201.

In an advantageous manner, the present invention is configured with axial symmetry, such that a male connector member 100 and a female connector member 200 come together along an axis and are self-aligned along the axis when mated. Moreover, one member may be rotated about an axis when inserted into the other connector member, reducing any potential physical stress caused by tension on the terminating lines, as well as simplifying the insertion of male connector member 100 into female connector member 200.

The axial symmetry of the present invention allows male connector member to be easily coaxially joined and removed with female connector member, since the joining or removing force for both male connector member and female connector member may be fully employed along the longitudinal axis.

Figure 2A:
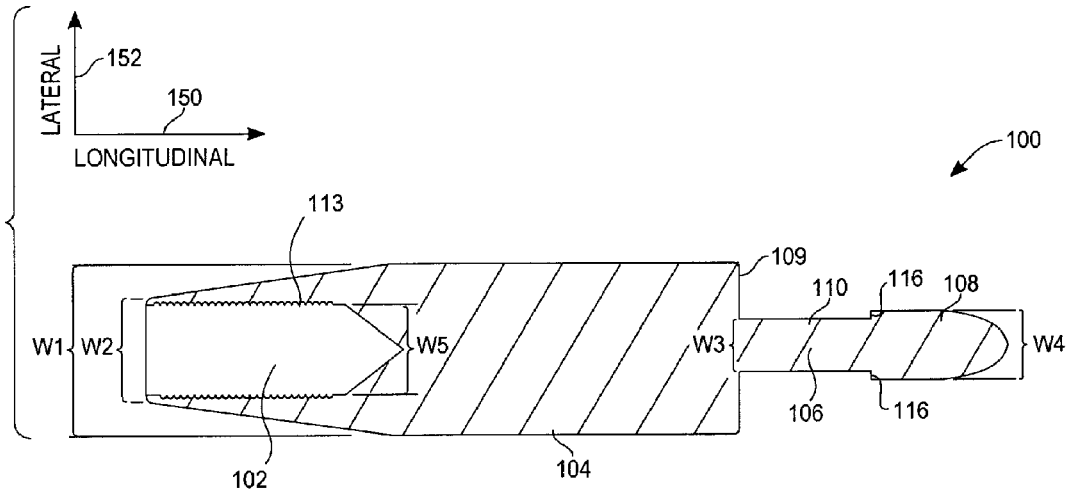
FIG. 2A is a side cutaway view of the male connector member of FIG. 1.

Referring to FIG. 2A, the male connector member 100 may be comprised of a male body section 104, a male rearward cavity 102, and a probe section 106. A lateral direction 152 as shown is parallel to the width or diameter of male connector member 100, whereas a longitudinal direction 150 is perpendicular to the lateral direction 152.

Male connector member 100 may be configured as a cylinder having a longitudinal axially symmetric body section, and may be further manufactured from any suitably machinable, tooled, or molded material, such as metal (e.g., aluminum, copper, steel, etc.), metal alloy, plastic, ceramic, etc.

In addition, male connector member 100 may be plated with conductive material, such as gold, in order to increase the conductivity for electrical applications. Male body section 104 may further have a substantially uniform width W1, i.e. diameter.

Longitudinally adjacent to center section 104 is axially symmetric probe section 106, including a probe head support structure 110 extending forwardly from shoulder 109 that is coupled to a head section 108. The width W3 of probe head support structure 110 is generally substantially less than width W1. Head section 108 may be further manufactured with different shapes, such as a bullet-shape, a cone shape, etc. The base width W4 of head section 108 is generally larger than width W3, and extends from the probe head support structure.

Also longitudinally adjacent to male body section 104 is a male rearward cavity 102 defined in the body section. Cavity 102 may be tapered, such that male cavity entrance width W2 is less than width W1. Male rearward cavity 102 is provided for receiving a first electrical, optical, or fluid line using any suitable method such as adhesive, friction fit, solder, etc.

In addition, male rearward cavity 102 may be scored or rifled with ridges 113. That is, helix shaped grooves are formed into the walls of male rearward cavity 102 in order to increase the adhesive surface area inside male rearward cavity 102, and hence increase its adhesive strength. Male cavity entrance width W2 of male rearward cavity 102 may be substantially the same as male rearward cavity inner width W5, such that the cavity walls are substantially parallel to the longitudinal direction. Likewise, male rearward cavity entrance width W2 may be substantially different from male rearward cavity inner width W5, such that a funnel is formed.

Figure 2B:
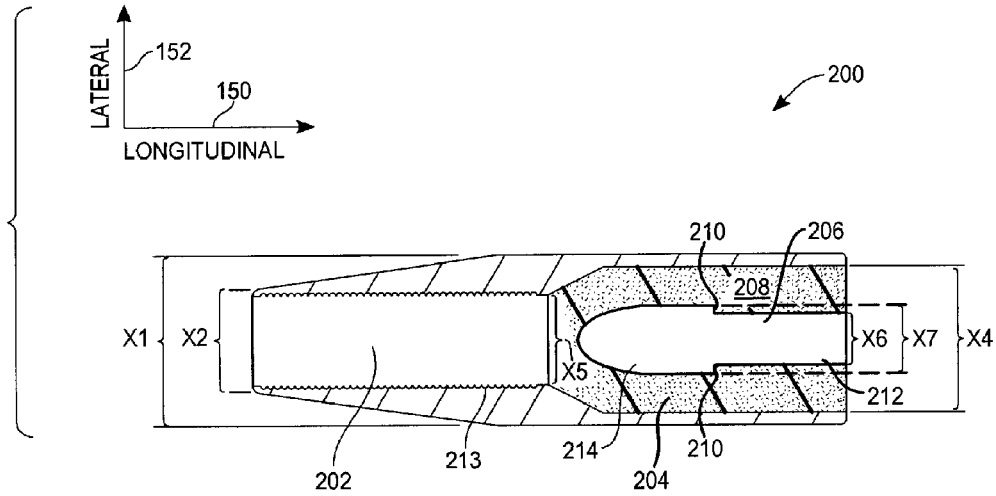
FIG. 2B is a side cutaway view of the female connector member of FIG. 1.

Referring to FIG. 2B, the female connector member 200 may be comprised of a female center body section 204, and a female rearward cavity 202.

Lateral direction 152 as shown is parallel to the width or diameter of female connector member 200, whereas longitudinal direction 150 is perpendicular to lateral direction 152.

As with the male connector member 100, female connector member 200 may be manufactured from any suitably machinable, tooled, or molded material, such as metal (e.g., aluminum, copper, steel, etc.), metal alloy, plastic, ceramic, etc. In addition, female connector member 200 may be further plated with conductive material, such as gold, in order to increase the conductivity for electrical applications. Body section 204 is cylindrical with an axially symmetric body section of width X1.

Longitudinally defined in body section 204 is female rearward cavity 202. Female rearward cavity 202 is provided for receiving a second electrical or optical component 201 using any suitable method such as adhesive, friction fit, solder, etc.

Female rearward cavity 202 may be tapered, such that female rearward cavity entrance width X2 is less than width X1. As before, the second electrical, optical, or fluid component may be attached using any suitable method such as adhesive, friction fit, solder, etc. In addition, female rearward cavity 202 may be scored or rifled. That is, helix shaped grooves are formed into the walls of female rearward cavity 202 in order to increase the adhesive surface area inside female rearward cavity 202, and hence increase its adhesive strength.

Female rearward cavity entrance width X2 of female rearward cavity 202 may be substantially the same as female rearward cavity inner width X5, such that the female rearward cavity walls are substantially parallel to the longitudinal axis. Likewise, female rearward cavity entrance width X2 may be substantially different from female reservoir cavity inner width X5, such that a funnel is formed.

Female body section 204 further includes an opening 206 of a width X4 configured to accept male probe 108 of FIG. 2A. In addition, an elastomer (i.e., urethane elastomer, etc.) or other flexible material 208 may be inserted in opening 206, such that a smaller axial formed opening 212 of width X6 substantially the same as width W3 of probe section 106, and width X7 substantially the same as width W4 of head section 108, is created. In the case of electrical components, the elastomer may include ultra fine powder gold plated nickel filler particles in order to increase the conductivity of the elastomer.

Elastomer 208 is further configured to secure male connector member 100 to female connector member 200. As probe section 106 is inserted in axial formed opening 212, with a pre-determined joining force, width X6 of cavity 202 formed by elastomer 208 is compressed, such that head section 108 may slide through formed opening 212 until it reaches region 214, clearing lateral opening faces (shoulders) 210.

Thereupon, probe section 106 is firmly secured both from the lateral compression of elastomer 208 on probe section 110, the longitudinal friction of elastomer 208 on probe section 110, and longitudinal force created by the resistance of probe section lateral base surfaces 116 against lateral cavity faces (shoulders) 210.

In addition, the amount of force necessary to engage and disengage male connector member 100 and female connector member 200 may be determined by the modulus of elasticity and coefficient of friction of elastomer 208, as well as the lateral length of probe section lateral base surfaces 116. That is, in general, the greater the lateral length of probe section lateral base surfaces 116, the greater the amount of force required.

In one configuration, in order to further increase the lateral and longitudinal forces required to couple or decouple probe section 106 from axial formed opening 212, a smaller diameter probe section may be used during the manufacturing process. That is, as electrometric material is injected into female connector member 200, the smaller diameter probe section may be inserted in order to form a cavity. Once the electrometric material has cured, the smaller diameter probe section may then be removed, leaving a smaller cavity than would have been formed had the actual larger probe section 106 been used. Consequently, the amount of force required to separate a coupled male connector member 100 to a female connector member 200 may be increased.

Furthermore, female connector member 200 may be further configured to wipe probe section 106 when the probe head enters and moves into the elastomer cavity. This is advantageous as it may wipe oxides and other contaminates from the microscopic contacting surfaces to expose the pure element for optimal conductivity.

Figure 2C:
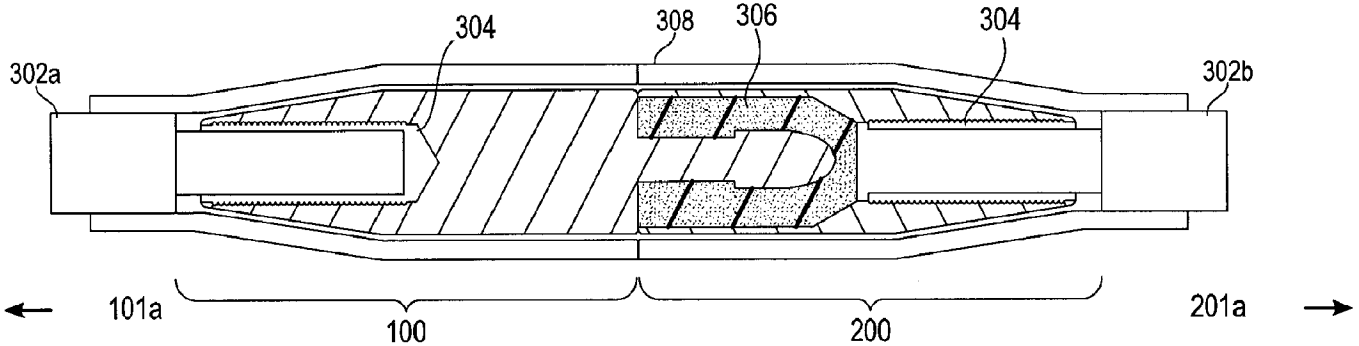
FIG. 2C is a side cutaway view of the male connector member of FIG. 2A coupled to the female connector member of FIG. 2B, for use in electrical applications.

Referring to FIG. 2C, male connector member 100 of FIG. 2A (coupled to electrical component 101*a*—not shown) is coupled to the female connector member 200 of FIG. 2B (coupled to electrical component 201*b*—not shown). Furthermore, in order to increase the electrical conductivity of the connector, both male connector member 100 and female connector member 200 may be plated with a metal conductor, such as gold, nickel, or copper.

In addition, insulated wires 302*a* and 302*b* may be attached to male connector member 100 and female connector member 200, respectively, by an appropriate method, such as soldering, crimping, welding etc.

Typically, insulated wire 302*a* may be coupled to electrical component 101*a* (not shown). The insulation is first striped off insulated wire 302*a*. The exposed wire may then be attached to the walls of male rearward cavity 102, as shown in FIG. 2A. Likewise, an insulated wire 302*b* may be coupled to electrical component 201*a* (not shown). The insulation is again first striped off insulated wire 302*b*. The exposed wire may then be attached to the walls of female rearward cavity 202, as shown in FIG. 2B.

Additionally, an ultra fine powder of gold plated nickel filler particles may be added to elastomer 306 in order to improve its conductivity. Consequently, a current may efficiently pass between female connector member 200 to male connector member 100 through elastomer 306.

In general, the volume resistivity of such materials is less than 0.001 ohm-cm. The percentage fill volume may be approximately 20 to 30 percent depending on the properties of the elastomer, the required degree of elastomer compression, connecting/disconnecting duty cycle, temperature of operation and other factors.

In one configuration, the ultra fine powder gold plated nickel filler particles comprise 24% by volume of elastomer 306. Consequently, the quick disconnect connector may be used in both high current "power" power applications without excessive heating, as well as lower current applications in "control", "instrumentation" and "electronic" circuits.

In addition, in order to insulate the electrical connector, both the male connector member 100 and the female connector member 200 may be covered with dielectric 308, or an electrical insulator, that is highly resistant to electric current. Examples of dielectric 308 may include porcelain, glass, plastics, shrink tubing, and industrial coatings. Furthermore, dielectrics such as shrink tubing may also extend over insulated wire 302*a-b* and further act as a strain relief.

Figure 2D:
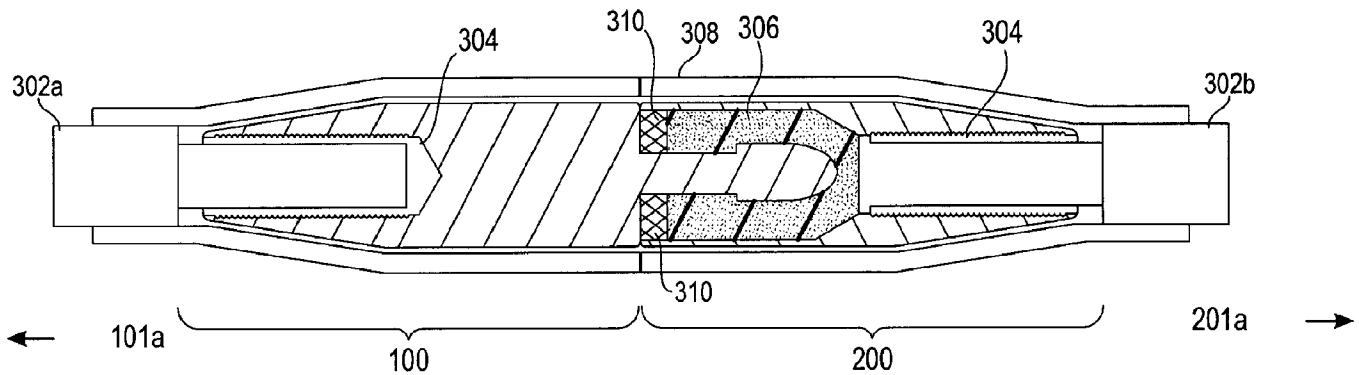
FIG. 2D is a side cutaway view of the male connector member and female connector member of FIG. 2C, with the addition of a non-conductive elastomer, for use in electrical applications.

Referring to FIG. 2D, male connector member 100 and female connector member 200 of FIG. 2C are shown, with the addition of a non-conductive elastomer 310. Generally, non-conductive elastomer 310 may be positioned between conductive particle filled elastomer 306 and male connector member 100, and further surround axially symmetric probe section 106, as shown in FIG. 2A. Non-conductive elastomer 310 generally shields conductive particle filled elastomer 306 from creating an electrical short, or accidental contact between two points in an electric circuit that have a potential difference, such as with a conductive fluid like moisture.

Here, non-conductive elastomer 310 may be further configured to seal opening 206 of female probe 200, when probe head support structure 110 and head section 108 are not inserted, as shown in FIGS. 2A-B. Consequently, should female connector member 200 be placed in water, non-conductive elastomer 310 may prevent an electrical short consequently protecting electrical component 201*a*.

Figure 3A:
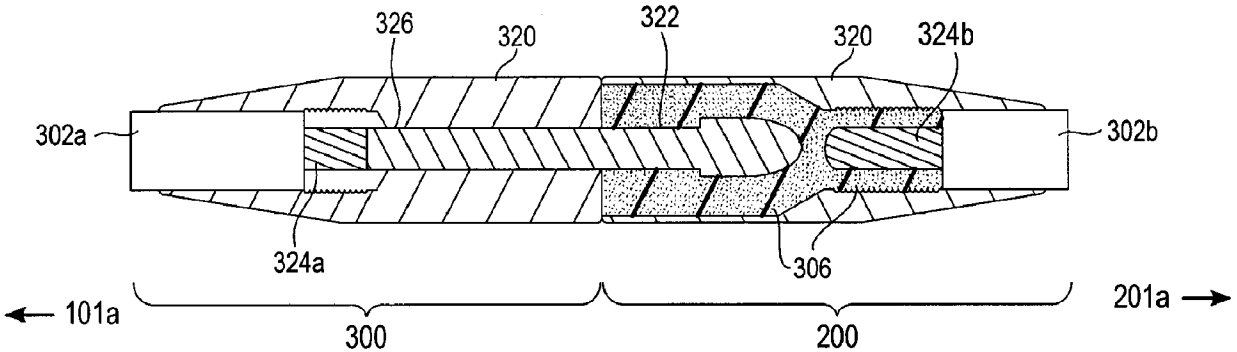
FIG. 3A is a side cutaway view of a dielectric male connector member of FIG. 2A coupled to a dielectric female connector member of FIG. 2B, for use in electrical applications.

Referring to FIG. 3A, a dielectric male connector member 300 with a conductive probe (coupled to electrical component 101*a*—not shown), is further coupled to the dielectric female connector member 200 of FIG. 2B (coupled to electrical component 201*b*—not shown). Here, unlike FIGS. 2A-D, male connector member 300 and female connector member 200 themselves are manufactured from a dielectric material, such as injection molded plastic.

In contrast, conductive probe 322 is a distinct element made from a conductive material commonly found in connectors, such as gold, copper, nickel, beryllium copper, etc. In addition, insulated wires 302 may be attached to male connector member 100 and female connector member 200, respectively, by an appropriate method, such as soldering, crimping, welding etc.

In the case of male connector member 300, an insulated wire 302*a* may be coupled to electrical component 101*a* (not shown). The insulation is first striped off insulated wire 302*a*. The exposed wire 324*a* may then be attached to the walls of male rearward cavity.

Likewise, an insulated wire 302*b* may be coupled to electrical component 201*a* (not shown). The insulation is again first striped off insulated wire 302*b*. Exposed wire 324*b* may then attached to the walls of female rearward cavity 202, as shown in FIG. 2B.

Additionally, ultra fine powdered gold plated nickel filler particles may be added to elastomer 306 in order to improve its conductivity. Consequently, a current may efficiently pass between female connector member 200 to male connector member 300 through elastomer 306. In one configuration, the ultra fine powdered gold plated nickel filler particles may comprise 24% by volume of elastomer 306.

Figure 3B:
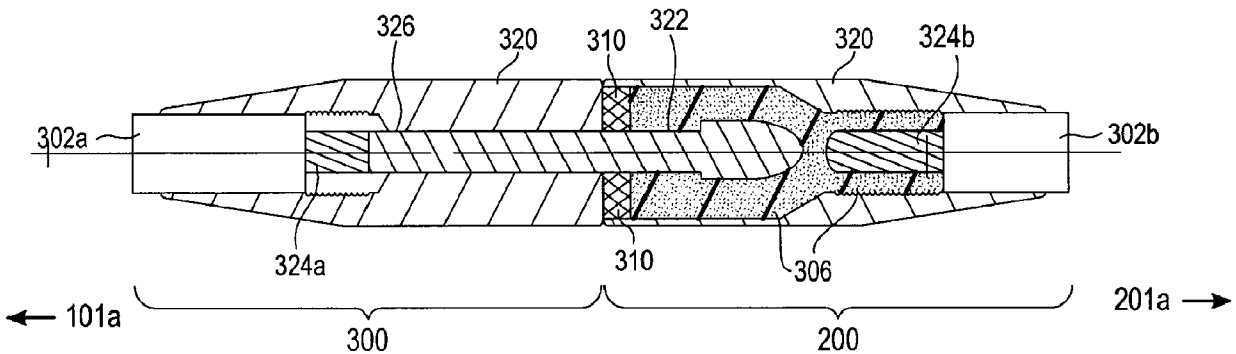
FIG. 3B is a side cutaway view of the dielectric male connector member and dielectric female connector member of FIG. 2C, for use in electrical applications.

Referring to FIG. 3B, the male connector member 300 and female connector member 200 of FIG. 2C are shown, with the addition of a non-conductive elastomer 310. Generally, non-conductive elastomer 310 may be positioned between conductive particle filled elastomer 306 and male connector member 300, and further surrounding axially symmetric probe section. Non-conductive elastomer 310 generally shields conductive particle filled elastomer 306 from creating a short circuit, or accidental contact between two points in an electric circuit that have a potential difference, such as a conductive fluid like moisture.

Here, non-conductive elastomer 310 may be further configured to seal opening 206 of female probe 200, when probe head support structure and head section are not inserted. Consequently, should female connector member 200 be placed in water, it may prevent a short circuit and protect electrical component 201*a*.

Figure 4:
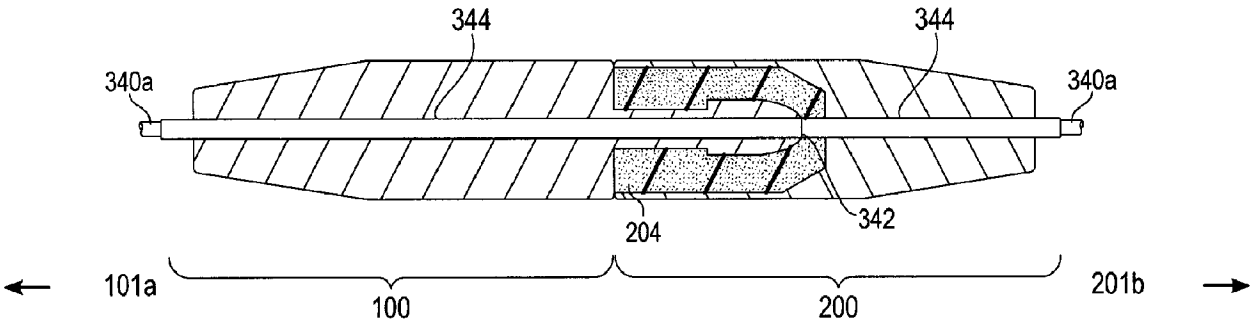
FIG. 4 is a side cutaway view of the male connector member of FIG. 2A coupled to the female connector member of FIG. 2B, for use in optical applications; and, FIG. 5 is a side cutaway view of a male connector member coupled to a female connector member, for use in fluid applications, in accordance with the present invention.

Referring to FIG. 4, male connector member 100 of FIG. 2A (coupled to an optical component 101*b*—not shown), may be coupled to the female connector member 200 of FIG. 2B (coupled to optical component 201*b*—not shown). Consequently, cladded optical fiber 344 with optical core 340*a-b* may be positioned coaxially in both male connector member 100 and female connector member 200. In general, at the flat optical interface contact 342, the flat ends of the fibers are configured to contact each other in a precision fit for optimal light transmission.

Figure 5:
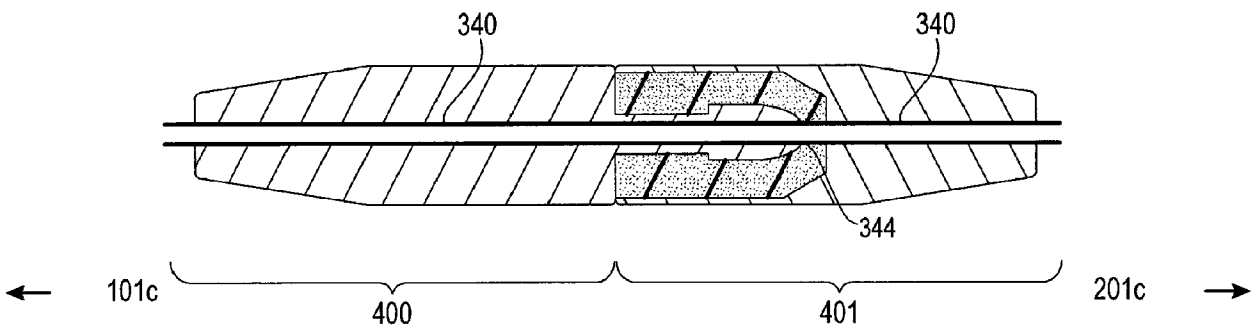

Referring to FIG. 5, a male connector member 400 (coupled to a fluid component 101*c*—not shown), may be further coupled to the female connector member 401 (coupled to a fluid component 201*c*—not shown). In general, tubing 340 (i.e. capillary tubing) is positioned coaxially in both member 400 and female connector member 401. At face-to-face contact 344, the flat ends of tubing 340 contact each other and a fluid or gas can flow through the connection.

Advantages of the invention include a reduction in the number of components compared to other connectors; the ability to quickly connect and disconnect; and a means of attachment that is not mechanical (i.e., screw type circular male/female rings, clips, clamps, etc.).

Additional advantages include a reduction in size and weight when compared to other connectors; an increase in safety by allowing quick disconnect in the event of a equipment/apparatus movement abnormality; an ability to resist shock and vibration while still maintaining conductivity; and an ability to seal the female connector member and male connector member from adverse conditions such as moisture and air.

Still more advantages include an ability to use a single linear movement in order to couple or decouple the connection; a wiping action when the probe head enters and moves into the elastomer cavity; an ability to quickly fabricate the male connector member and the female connector member through such techniques as injection molding; an elimination of clamping rings and other connector surface compression devices; and an ability for the male connector member to be connected to the female connector member without the aid of any external means.

What is claimed is:

1. A self-latching quick disconnect fastener comprising:

a male member for joining to a first electrical line including, a male body section, a probe section coupled to said body section, said probe section further including a probe head support structure coupled to a forward head section;

a cavity defined rearwardly in said male body section for receiving said first electrical line;

a female member for joining to a second electrical line including, a female body section having an opening including, a flexible material in said opening configured to compressibly form around an entirety of said forward head section of said probe section when said male member is coupled to said female member;

a cavity section defined rearwardly in said female body section for joining to said second electrical line.

2. The apparatus of claim 1, wherein said male member and said male member include at least one of a metal, a metal alloy, a plastic, and a ceramic.

3. The apparatus of claim 1, wherein said male body section and said female body section are axially symmetric.

4. The apparatus of claim 1, wherein said male body section is plated with gold.

5. The apparatus of claim 1, wherein said male body section and said female body section are both covered with a dielectric material.

6. The apparatus of claim 1, wherein said flexible material further includes a non-conductive elastomer.

7. The self-latching disconnect fastener of claim 1 wherein said flexible material in said opening is configured to compressibly form around said probe head support structure of said probe section when said male member is coupled to said female member.

8. The apparatus of claim 1, wherein said flexible material is a conductive elastomer.

9. The apparatus of claim 8, wherein at least one of said cavity section in the male body section and said cavity section in the female body section is scored.

10. The apparatus of claim 9, wherein at least one of said male cavity section and said female cavity section includes at least one of an adhesive, a friction fit, and a solder.

11. The apparatus of claim 1, wherein said flexible material includes a set of gold-plated nickel filler particles.

12. The apparatus of claim 11, wherein the fill volume of said gold-plated nickel filler particles is between about 20% and about 30%.

13. A quick disconnect fastener comprising:

an elongate male member having an axially symmetric probe section extending from a shoulder of an axially symmetric male body section with a diameter, the probe section with a forwardly projecting head that is wider than the probe section, the male body section having a rearwardly opening cavity in the male body section having an axial dimension for admitting a first electrical line, and an elongate female member having an axially symmetric female body section defining a forward axial opening with an outward entrance receiving the probe section of the male member with the shoulder of the male member abutting the female member at the outward entrance, the forward axial opening containing an elastomer with a formed opening therein of a dimension smaller than the width of the probe section whereby the probe section frictionally engages the elastomer causing the male member to be frictionally retained in the female member, the female body section having a rearwardly opening cavity having an axial dimension admitting a second electrical line.

14. The fastener of claim 13 wherein the female body section has the same diameter as the male body section.

15. A quick disconnect fastener comprising:

a male member for joining to a first electrical line, including, a male body section, a bullet-shaped probe section coupled to said body section, said probe section further including a probe head support structure coupled to a head section;

a male cavity section defined in said male body section for receiving said first electrical line;

a female member for joining to a second electrical line including, a female body section having an opening including, an elastomer material disposed in the opening configured to compressibly form around an entirety of said head section of said bullet-shaped probe section when said male member is coupled to said female member;

a female cavity section defined in said female body section for joining to said second electrical line.

16. The quick disconnect fastener of claim 15 wherein said elastomer material disposed in said opening is configured to compressibly form around said probe head support structure of said probe section when said male member is coupled to said female member.

17. A self-latching quick disconnect fastener comprising:

a male member for joining to a first optical line including, a male body section, a probe section coupled to said body section, said probe section further including a probe head support structure coupled to a forward head section;

a cavity defined rearwardly in said male body section for receiving said first optical line;

a female member for joining to a second optical line including, a female body section having an opening including, a flexible material in said opening configured to compressibly form around an entirety of said forward head section of said probe section when said male member is coupled to said female member;

a cavity section defined rearwardly in said female body section for joining to said second optical line.

18. The self-latching quick disconnect fastener of claim 17 wherein said flexible material in said opening is configured to compressibly form around said probe head support structure of said probe section when said male member is coupled to said female member.

19. A self-latching quick disconnect fastener comprising:

a male member for joining to a first fluid line including, a male body section, a probe section coupled to said body section, said probe section further including a probe head support structure coupled to a forward head section;

a cavity defined rearwardly in said male body section for receiving said first fluid line;

a female member for joining to a second fluid line including, a female body section having an opening including, a flexible material in said opening configured to compressibly form around an entirety of said forward head section of said probe section when said male member is coupled to said female member;

a cavity section defined rearwardly in said female body section for joining to said second fluid line.

20. The self-latching quick disconnect fastener of claim 19 wherein said flexible material in said opening is configured to compressibly form around said probe head support structure of said probe section when said male member is coupled to said female member.

* * * * *